US011293087B2

(12) United States Patent
Petroix et al.

(10) Patent No.: US 11,293,087 B2
(45) Date of Patent: Apr. 5, 2022

(54) METHOD FOR LOW-PRESSURE CARBURIZING OF A WORKPIECE COMPRISING STEEL

(71) Applicant: SAFRAN HELICOPTER ENGINES, Bordes (FR)

(72) Inventors: Bruno Petroix, Moissy-Cramayel (FR); André Marcarie, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 15 days.

(21) Appl. No.: 15/734,542

(22) PCT Filed: Jun. 5, 2019

(86) PCT No.: PCT/FR2019/051338
§ 371 (c)(1),
(2) Date: Dec. 2, 2020

(87) PCT Pub. No.: WO2019/234352
PCT Pub. Date: Dec. 12, 2019

(65) Prior Publication Data

US 2021/0230732 A1 Jul. 29, 2021

(30) Foreign Application Priority Data

Jun. 5, 2018 (FR) ..... 1854876

(51) Int. Cl.
*C23C 8/22* (2006.01)
*C22C 38/44* (2006.01)
(Continued)

(52) U.S. Cl.
CPC ..... *C23C 8/22* (2013.01); *C22C 38/44* (2013.01); *C22C 38/46* (2013.01); *C22C 38/52* (2013.01); *C23C 8/80* (2013.01)

(58) Field of Classification Search
CPC ..... C23C 8/22; C23C 8/80; C22C 38/52
See application file for complete search history.

(56) References Cited

U.S. PATENT DOCUMENTS 6,451,137 B1 9/2002 Pelissier
7,118,634 B2 10/2006 Goldsteinas et al.

FOREIGN PATENT DOCUMENTS

EP 1101826 A1 5/2001
FR 2678287 A1 12/1992
(Continued)

OTHER PUBLICATIONS

International Search Report dated Jul. 24, 2019, issued in corresponding International Application No. PCT/FR2019/051338, filed Jun. 5, 2019, 6 pages.
(Continued)

*Primary Examiner* — Jessee R Roe
(74) *Attorney, Agent, or Firm* — Christensen O'Connor Johnson Kindness PLLC

(57) ABSTRACT

A method for carburizing a steel workpiece includes implementing between 1 and 30 consecutive carburizing cycles, each carburizing cycle including injecting carburizing gas in such a way as to increase the surface carbon rate until a predetermined higher rate is reached, a step of injecting a neutral gas so as to decrease the surface carbon rate of the workpiece until it reaches a predetermined lower rate, followed by a second phase of injection of the neutral gas.

12 Claims, 1 Drawing Sheet

(51) Int. Cl.

| | |
|---|---|
| ***C22C 38/46*** | (2006.01) |
| ***C22C 38/52*** | (2006.01) |
| ***C23C 8/80*** | (2006.01) |

(56) References Cited

FOREIGN PATENT DOCUMENTS

| | | | |
|---|---|---|---|
| FR | 2821362 | A1 | 8/2002 |
| FR | 2847591 | A1 | 5/2004 |
| WO | 2016160751 | A1 | 10/2016 |

OTHER PUBLICATIONS

Written Opinion of the International Searching Authority dated Jul. 24, 2019, issued in corresponding International Application No. PCT/FR2019/051338, filed Jun. 5, 2019, 6 pages.

English translation of the Written Opinion of the International Searching Authority dated Jul. 24, 2019, issued in corresponding International Application No. PCT/FR2019/051338, filed on Jun. 5, 2019, 6 pages.

METHOD FOR LOW-PRESSURE CARBURIZING OF A WORKPIECE COMPRISING STEEL

TECHNICAL FIELD

The present invention relates to a method for low-pressure carburizing of a workpiece comprising steel.

BACKGROUND

The term carburizing refers to a classical method in the field of metallurgy. It is a thermochemical treatment that consists in making carbon (C) penetrate superficially into a steel workpiece in order to transform it, on the surface, into a highly carburized steel. A steel is called a metal alloy consisting mainly of iron (Fe) and carbon (with a mass rate, for the carbon (C), close to 0%, corresponding to minute traces, up to a rate of 2%). The carbon content has a considerable influence on the properties of the steel. Below 0.008% of carbon (C), for example, steel is rather malleable and is called "iron". In particular, the carbon (C) content profoundly modifies the melting temperature and the mechanical properties of the steel. Increasing the carbon content of a steel improves its hardness (resistance opposed by a surface to the penetration of a tip) and reduces its elongation at break. Increasing the carbon content of the surface thus increases the surface mechanical properties of the workpiece, and increases its wear resistance and endurance.

Carburizing creates a decreasing carbon gradient towards the core of the workpiece. The carbon concentration is thus enriched at the surface of the workpiece. The carburizing method has been known for more than a hundred years, its implementation has evolved considerably since its beginnings, and it has been practiced in gaseous form for more than 20 years. In particular, today, the most frequently used method is low pressure gaseous carburizing (LPC), which is a carburizing method carried out in a vacuum carburizing enclosure, using gaseous hydrocarbons at very low pressure and high temperature in order to obtain a carbon-enriched and hardened surface layer, as described in the documents—FR 2 678 287 A1 and WO 2016/160751 A1.

Low-pressure carburizing is a carburizing method carried out in a cold wall vacuum furnace, using gaseous hydrocarbons at low pressure: 2 to 20 mbar absolute, e.g. 10 mbar, and at elevated temperature.

ECM Technologies' Infracarb® method is the patented method used in our Modular Carburizing and Treatment Facility. More precisely, Infracarb® consists in an alternating injection of C2H2 hydrocarbon to create a surface enrichment by cracking the molecules at high temperature and a neutral gas N2 for diffusion.

The difficulty of LPC carburizing lies in limiting the depth of carbon diffusion, particularly when carburizing materials that are very sensitive to the presence of carbon, such as the Ferrium® C61™ and Ferrium® C64™ alloys marketed by Questek, for which the surface rate of carbon (C) must not exceed 0.5%.

Indeed, the Ferrium® C61™ and C64™ alloys differ from conventional compositions (e.g. compositions comprising 0.16% carbon (C), 3% nickel (Ni), less than 1% chromium (Cr) and traces of molybdenum (Mo) by higher levels of carbon (C) and gammagenic elements: for example, levels of around 0.2% carbon (C), 9% nickel (Ni), 3.5% chromium (Cr) and 1% molybdenum (Mo).

The gammagenic elements, including cobalt (Co), nickel (Ni), nitrogen (N), copper (Cu), are addition elements that increase the stability range of a particular iron allotrope: austenite. Austenite allows a high solubility of carbon. The vast majority of so-called stainless steels are austenitic and combine good corrosion resistance with high mechanical properties.

However, these Ferrium® C61™ and Ferrium® C64™ alloys also contain a higher proportion of alphagenic elements, such as molybdenum (Mo) and chromium (Cr). Alphagenic elements tend to destabilize austenite in favor of ferrite. Ferrite is an allotrope of steel that dissolves carbon (C) poorly and has ferromagnetic properties at low temperatures. Thus, as soon as the carbon (C) concentration becomes too high, the precipitation of ferric complexes forming undesirable bodies is observed with a catastrophic effect on the microstructure of the steel workpiece. Indeed, these ferric precipitates take the form of carbides forming networks that locally reinforce the hardness of the workpiece but weaken the workpiece as a whole.

Thus, it is necessary to be able to carburize the workpiece in the right proportions of carbon (C) in order to reinforce the mechanical surface properties of the workpiece, without altering its microstructure.

For the alloys Ferrium® C61™ and Ferrium® C64™, the desired properties are particularly dependent on variations in the metallographic structure and the surface rate of carbon (C). These two characteristics depend directly on the thermochemical treatments used during the carburizing method. Obtaining a structure with the characteristics necessary for the proper use of the workpiece therefore depends directly on the parameters defined during carburizing.

The invention aims to achieve this objective. It thus proposes a low-pressure carburizing method adapted to steel workpieces comprising alphagenic and gammagenic elements.

DESCRIPTION OF THE INVENTION

The purpose of the invention is thus a method for low-pressure carburizing of a workpiece comprising, in particular on its surface, steel, said steel comprising, in weight percent:

from 0.10% to 0.20% in carbon (C),
from 0.1% to 20% in cobalt (Co),
from 2% to 15% in nickel (Ni),
from 1% to 10% in chromium (Cr),
characterized in that said method comprises:

a) a step of placing said workpiece in a carburizing enclosure, and
b) implementing between 1 to 30 consecutive carburizing cycles, each cycle comprising:
   i) a step of injecting carburizing gas, referred to in this case as the "carburizing step", into the carburizing enclosure, so as to enrich the surface of the workpiece with carbon and to increase the surface rate of carbon of the workpiece to a predetermined higher surface rate, the carburizing gas being injected into the enclosure at a flow rate of between 1000 Nl/h and 3000 Nl/h, the temperature of the enclosure being between 950° C. and 1050° C., and for a period of time between 30 and 250 s, and
   (ii) a step of injecting a neutral gas into the carburizing enclosure so as to diffuse the carbon from the surface to the interior of the workpiece, and to decrease the surface rate of carbon of the workpiece to a predetermined lower surface rate, the neutral gas injection step comprising a first phase of neutral gas injection, at a flow rate of between 1000 and 10000 Nl/h, and for a period of time of between 5 and 60 s, followed by a second phase of neutral gas injection, at a flow rate of between 500 Nl/h and 3000 Nl/h, and for a period of time of between 10 and 2000 s.

This allows carburizing to be carried out in an inert atmosphere, in particular under partial pressure of neutral gas (e.g. nitrogen ($N_2$)) and no longer under vacuum. Diffusion is thus carried out under neutral gas partial pressure after a purging phase using a high neutral gas flow rate). This results in healthy structures, free of network-forming intergranular precipitates and with an acceptable residual austenite content.

The multiplication of the injection steps makes it possible not to oversaturate the surface of the austenite, and to bring the right quantity of carbon (C) within the maximum limits of subsurface diffusion absorption of the steel (this absorption being a function of the required carburizing depth). Consequently, this multiplication of the injection steps avoids the formation of undesirable compounds, especially in the subsurface zone (e.g. cementite precipitates at grain boundaries).

Thus, the injection step allows the carbon (C) enrichment, and the diffusion step allows the dilution and diffusion of this carbon (C) enrichment in the austenite in order to reach the desired depth. This diffusion thus avoids supersaturation at the surface and the precipitation of carbon (C) which can possibly lead to soot deposits harmful to the enrichment of the steel.

The method according to the invention may comprise one or more of the characteristics or steps below, taken in isolation from one another or in combination with one another:

- the predetermined higher surface rate of carbon is the same for all cycles,
- the carburizing gas is selected from propane ($C_3H_8$) and acetylene ($C_2H_2$),
- the carburizing gas has a dilution ratio of between 0 and 75%, a very low dilution ratio being preferred for high carburizing depths and a very high dilution ratio being preferred for (very)shallow carburizing depths,
- the carburizing gas is injected at a pressure of between 0.1 bar and 3 bar, taking care to respect a corresponding enclosure pressure,
- the neutral gas is selected from dinitrogen ($N_2$) and argon (Ar),
- the neutral gas is injected at a pressure of between 0.1 and 7 bar and,
- after the last carburizing cycle, the method comprises a final diffusion step followed by a cooling step during which the cooling rate is between 7° C./min and 200° C./min,
- the cooling step following the final diffusion step is implemented outside the carburizing enclosure, in a dedicated cooling cell.
- the surface mass rate of carbon (C) at the end of the cooling step is between [0.4] and [0.6]%.
- the pressure in the carburizing enclosure is between 0.002 bar and 0.025 bar, the pressure increase being aimed at improving the carburizing of confined zones,
- the workpiece is made of said steel.

DESCRIPTION OF THE FIGURES

The invention will be better understood and other details, characteristics and advantages of the invention will appear when reading the following description made as a non-limitative example and with reference to the appended drawings in which.

DETAILED DESCRIPTION

The method described here applies advantageously to a workpiece 1 comprising or consisting of a steel containing alphagenic and gammagenic elements, said steel comprising, for example, in weight percent:

from 0.10% to 0.20% carbon (C),
from 0.1% to 20% in cobalt (Co),
from 2% to 15% in nickel (Ni),
from 1% to 10% in chromium (Cr).

The method is preferably applied to a workpiece 1 comprising or consisting of an alloy of the type Ferrium® C61™ and Ferrium® C64™. The Ferrium® C61™ alloy is a steel with a composition:

0.15% carbon (C),
3.5% chromium (Cr)
9.5% nickel (Ni)
18% cobalt (Co),
1.1% in molybdenum (Mo),
0.08% in vanadium (V).

The Ferrium® alloy C64™ is a steel of composition:

0.11% in carbon (C),
3.5% in chromium (Cr)
7.5% in nickel (Ni)
16.3% in cobalt (Co),
1.75% in molybdenum (Mo),
0.2% in tungsten (W),
0.02% in vanadium (V).

In this example, the tested alloy is pure iron.

Figure 1:
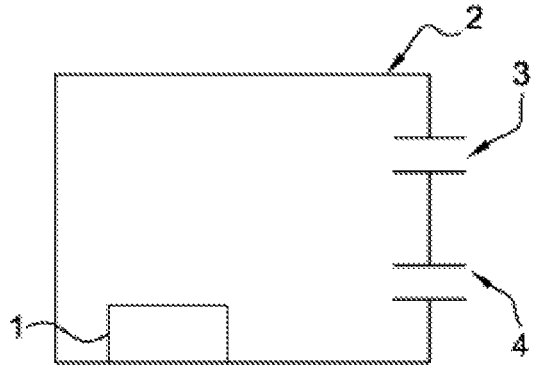
FIG. 1 is a diagram of a low-pressure carburizing enclosure in which is deposited a workpiece intended to be carburized according to the method of the present invention.

As can be seen in FIG. 1, the method according to the invention consists of one or more successive cycles. In the example shown in FIG. 2, it implements a succession of four cycles C1, C2, C3, C4. Each cycle C1, C2, C3, C4 comprises a step 10 of injecting a carburizing gas, for example propane ($C_3H_8$) or acetylene ($C_2H_2$), followed by a step 12 of injecting a neutral gas, for example argon (Ar) or dinitrogen ($N_2$). This step is a step 12 of diffusion under partial pressure of a neutral gas. Preferably, each step 10 of injecting the carburizing gas is directly followed by the step 12 of injecting the neutral gas.

The method comprises first of all a step of placing the workpiece 1 in a carburizing enclosure 2, as shown in FIG. 1. This carburizing enclosure 2 comprises a gas inlet 3 and a gas outlet 4 and can be sealed in a tight and isothermal manner.

Once the workpiece 1 has been placed in carburizing enclosure 2, the enclosure is closed and heated. Once the workpiece 1 has reached a stabilized target temperature, the sequence of cycles C1, C2, C3, C4 begins.

Figure 2:
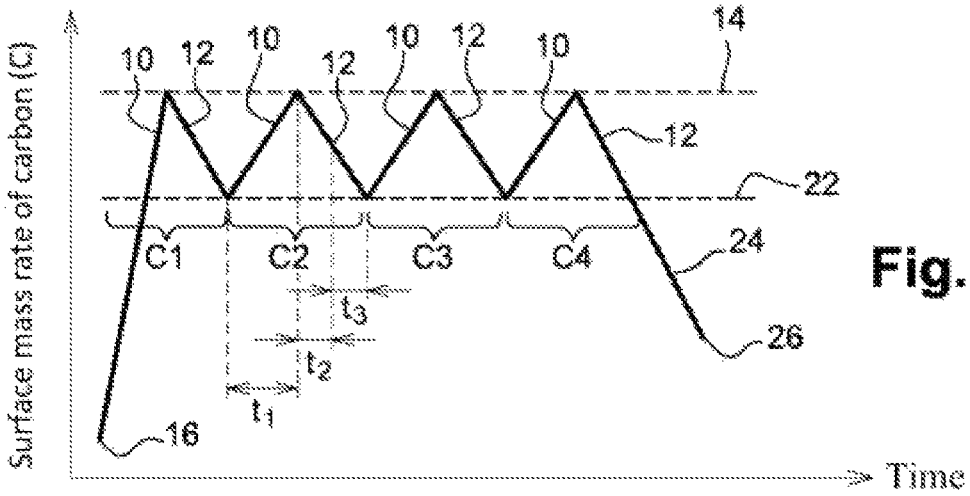
FIG. 2 is a schematic diagram of the mass rate of carbon (C) present on the surface of a workpiece subjected to a low-pressure carburizing method according to the invention, as a function of time.

As shown in FIG. 2, the first step of each cycle C1, C2, C3, C4 is a injecting carburizing gas step 10 (also called carbon enrichment step) into the carburizing enclosure 2. This enrichment step 10 has a period of time $t_1$ between 30 and 250 s, preferably between 50 and 150 s. The period of time $t_1$ of the enrichment step 10 is a function of a predetermined and ultimately targeted higher surface rate 14 of carbon (C) (i.e. temperature to be reached at the end of the method) on the surface of the workpiece 1. "Surface" here means substantially zero depth, preferably zero. Under optimal conditions, this higher surface rate 14 can correspond to the solubility limit of carbon (C) in austenite at the given carburizing temperature. This higher surface rate 14 is typically higher than the initial surface rate 16 of carbon (C) of the workpiece 1 to be treated.

During this enrichment step 10, the carburizing gas is injected into the carburizing enclosure 2 at a flow rate between 1000 Nl/h and 3000 Nl/h (preferably between 1300 and 1700 Nl/h), the carburizing temperature being between 950° C. and 1050° C. (and preferably equal to 1000° C.±10° C.).

The unit Nl/h is a normo liter per hour. The normo liter is derived from the normo cubic metre. The normo cubic meter, symbol Nm3 or sometimes m3(n), is a unit of measurement of quantity of gas which corresponds to the content of a volume of one cubic meter, for a gas under normal conditions of temperature and pressure (0 or 15 or more rarely 20° C. according to the reference systems and 1 atm, i.e. 101 325 Pa).

This is a usual unit, however not recognized by the International Bureau of Weights and Measures. For a pure gas, one normo cubic meter corresponds to about 44.6 moles of gas.

In particular, the dilution rate of the injected carburizing gas is between 0 and 75%, preferably between 0 and 25%, and the carburizing gas is injected at a pressure between 0.1 bar and 3 bar, preferably equal to 230±50 mbar. The "dilution ratio" here refers to a dilution of the carburizing gas in a neutral gas, typically argon (Ar) or dinitrogen ($N_2$).

During the enrichment step 10, partial or total saturation of the austenite on the surface of the steel workpiece occurs. The desired maximum carbon content (C) 14 at the end of the enrichment step 10 depends on the steel grade and the temperature at which carburizing is carried out.

Figure 3:
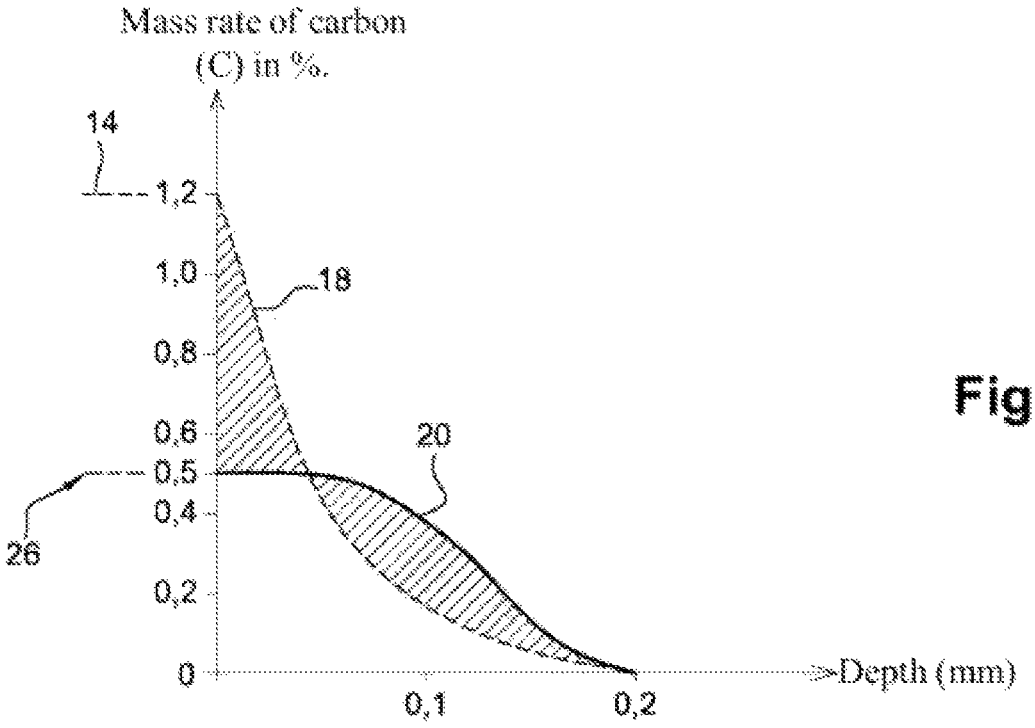
FIG. 3 is a graphical representation of the mass rate of carbon (C) present in the workpiece as a function of the distance from the surface to the core of said workpiece, and at different steps of a method cycle according to the invention, for a pure iron sample.

At the end of step 10 of injecting carburizing gas, the carbon (C) molecules that have enriched the carbon (C) content of the workpiece 1 are diffused towards the core of the workpiece 1, in order to homogenize its composition, as shown in FIG. 3.

FIG. 3 represents the carbon profile of a workpiece 1 subjected to the method according to the invention, i.e. the mass rate of carbon present in the workpiece 1 as a function of the distance from the surface to the core of said workpiece 1, i.e. the depth of the workpiece 1. FIG. 3 shows both a carbon (C) 18 (dotted line) at the end of the enrichment step 10, before the start of the diffusion step 12, and a carbon (C) 20 (solid line) at the end of the diffusion step 12. It can thus be seen that the rate 18 of carbon (C) as a function of depth at the end of the enrichment step 10 shows a substantially exponential decrease: at the surface of the workpiece, the rate 18 of carbon (C) is very high, whereas at a depth of 0.2 mm, the rate of carbon (C) is equal to a value close to 0 (in the case of the pure iron sample used for the measurements illustrated in FIG. 3).

The second step of each cycle C1, C2, C3, C4 is a diffusion step 12. This diffusion step 12 takes place in a neutral atmosphere and thus requires, as indicated above, the injection of a neutral gas such as dinitrogen ($N_2$) or argon (Ar) into the carburizing enclosure 2. Thus, as soon as the enrichment step 10 is completed, neutral gas is injected into the carburizing enclosure 2.

The gas sweep generated when the neutral gas enters makes the removal of the carburizing gas molecules from the surface of the workpiece 1 more efficient. Indeed, this gas molecules removal de facto stops the ongoing enrichment. In a vacuum atmosphere, the removal of these molecules is much slower.

More particularly, step 12 of diffusion is composed of two phases: a phase of purging of the carburizing gas with a period of time $t_2$ between 5 and 60 s (preferably 10±5 s), and a phase of diffusion itself, with a period of time $t_3$ between 10 and 2000 s (preferably 30 to 2000 s). The period of time of the diffusion step 12 is therefore, as shown in FIG. 2, of $(t_2+t_3)$.

In the chosen example, the values $t_1$, $t_2$, $t_3$ have been taken identical for simplification. In fact, depending on the desired fineness of treatment, they are often called upon to be modified (adjusted) from one cycle C1, C2, C3, C4 to the next.

The difference between the two phases of the diffusion step 12 lies in the injection rate of the neutral gas. During the period of time $t_2$ of the purging phase, the neutral gas is injected into carburizing enclosure 2 at a flow rate of 1000 to 10000 Nl/h, preferably 6000±500 Nl/h, at a neutral gas pressure in enclosure 2 of 0.1 to 7 bar, preferably equal to 230±50 mbar. During the period of time of $t_3$ each diffusion phase, after the purging phase, the neutral gas is injected at a flow rate of between 500 Nl/h and 3000 Nl/h, preferably equal to 1800±500 Nl/h, the pressure in the carburizing enclosure 2 being between 2 and 25 mbar, preferably between 7 and 13 mbar.

As can be seen in FIG. 3, at the end of the diffusion step 12, the rate 20 of carbon (C) as a function of depth of the workpiece 1 shows substantially a plateau at a depth of 0 to 0.1 mm, before decreasing to reach a rate close to 0 (for the pure iron sample for which the values are shown in FIG. 3) at a depth of 0.2 mm.

FIG. 2 shows that the predetermined lower surface rate 22 of carbon (C) at the end of the diffusion step 12 (comprising a purge phase and a diffusion phase) is lower than the higher surface rate 14 of carbon (C) obtained at the end of the enrichment step 10. This predetermined lower surface rate 22 of carbon (C) may, however, be higher than the initial surface rate of carbon (C).

It is important to bear in mind, however, that the lower surface rate does not correspond to a physical value, a material characteristic, or a fixed or controlled value. The value of this lower surface rate 22 is obtained downstream of the methods of implementation of the carburizing aimed by the present invention, namely, very globally:

the treated material and the targeted carburized depth, the characteristics of the carburizing system used.

The precise value of this lower surface rate 22 is in fine neither measured nor really known.

As the method is cyclic, after step 12 of diffusion of a given cycle C1, C2, C3, one passes to a new cycle C2, C3, C4 and thus to a new enrichment step 10. The enrichment step 10 and diffusion step 12 follow one another cyclically and the number of cycles C1, C2, C3, C4 is between 1 and 30, preferably between 1 and 15. As can be seen in FIG. 1, the higher 14 and lower 22 surface rate of carbon (C) obtained at the end of the different steps 10, 12 remain unchanged throughout the method. As an example, a number of four cycles C1, C2, C3, C4 have been illustrated in FIG. 2.

A change in the number of cycles impacts the desired maximum carbon (C) rate 14 and the predetermined lower surface rate 22, as well as the total diffused depth and the final carbon profile.

When the desired number of cycles C1, C2, C3, C4 has been reached, after the last diffusion step of the last cycle C4, a final diffusion step 24 and then a cooling step are carried out, and a drop in the surface rate of carbon (C) is observed. Cooling can be carried out outside carburizing enclosure 2, in a dedicated cooling cell (not shown). Cooling allows the temperature of the workpiece 1 to be gradually reduced from its carburizing temperature to a temperature suitable for handling the workpiece 1. The cooling rate of the carburizing enclosure 2 or the dedicated enclosure is between 7° C./min and 200° C./min, preferably 120±50° C./min.

Following this final diffusion step 24, the final surface rate 26 of carbon (C) is lower than the lower rate 22 of carbon (C) obtained at the end of the diffusion step 12, but it may be higher than the initial rate 16, as shown in FIG. 2.

The final surface rate 26 of carbon (C) is intended to be as close as possible to the theoretical optimal surface rate of carbon (C) (0.5% by mass for Ferrium steels).

Depending on the chemical composition of the steel and the nature of the zones to be carburized, the targeted and obtained lower 22 and higher 14 surface rates result from the physical parameters of the workpiece 1 to be carburized and those of the carburizing enclosure 2 used.

Different combinations of the different ranges of parameter values given above make it possible to obtain different thermochemical treatments of the workpiece 1 treated. These differences relate in particular to the carburized depth and the type of carburized structure obtained. The shape of the carburized workpiece 1 (e.g. workpieces with teeth) must also be taken into account when setting the parameters of the carburizing method.

The invention claimed is:

1. A method for low-pressure carburizing of a workpiece comprising steel, said steel comprising, in weight percent:

from 0.10% to 0.20% in carbon (C), from 0.1% to 20% in cobalt (Co), from 2% to 15% in nickel (Ni), and from 1% to 10% in chromium (Cr), the method comprising:

placing said workpiece in a carburizing enclosure, and implementing between 1 to 30 consecutive carburizing cycles, each carburizing cycle comprising:

injecting a carburizing gas into the carburizing enclosure, so as to enrich a surface of the workpiece with carbon and to increase a surface rate of carbon of the workpiece up to a predetermined higher surface rate, the carburizing gas being injected into the enclosure at a first flow rate of between 1000 Nl/h and 3000 Nl/h, a temperature of the carburizing enclosure being between 950° C. and 1050° C., and injecting the carburizing gas for a first period of time of between 30 and 250 s, and injecting a neutral gas into the carburizing enclosure, so as to diffuse carbon from the surface to an interior of the workpiece, and to decrease the surface rate of carbon of the workpiece to a predetermined lower surface rate, wherein injecting the neutral gas comprises a first phase of injecting the neutral gas, at a second flow rate of between 1000 and 10000 Nl/h, and for a second period of time of between 5 and 60 s, followed by a second phase of injecting the neutral gas, at a third flow rate of between 500 Nl/h and 3000 Nl/h, and for a third period of time of between 10 and 2000 s.

2. The method according to claim 1, wherein the predetermined higher surface rate of carbon is the same for all cycles.

3. The method according to claim 1, wherein the carburizing gas is propane ($C_3H_8$) or acetylene ($C_2H_2$).

4. The method according to claim 1, wherein the carburizing gas has a dilution ratio of between 0 and 75%.

5. The method according to claim 1, wherein injecting the carburizing gas comprises injecting the carburizing gas at a pressure of between 0.1 bar and 3 bar.

6. The method according to claim 1, wherein the neutral gas is dinitrogen ($N_2$) or argon (Ar).

7. The method according to claim 1, wherein the neutral gas is injected at a pressure of between 0.1 bar and 7 bar.

8. The method according to claim 1, further comprising, after implementing the carburizing cycles, a final diffusion step followed by a cooling step during which a cooling rate is between 7° C./min and 200° C./min.

9. The method according to claim 8, wherein the cooling step is implemented outside the carburizing enclosure, in a dedicated cooling cell.

10. The method according to claim 8, wherein a surface mass rate of carbon at an end of the final diffusion step is between 0.4 and 0.6%.

11. The method according claim 1, wherein an enclosure pressure in the carburizing enclosure is between 0.002 bar and 0.025 bar.

12. The method according to claim 1, wherein the workpiece consists of said steel.

* * * * *